US005184479A

United States Patent [19]

Koberstein et al.

[11] Patent Number: 5,184,479

[45] Date of Patent: Feb. 9, 1993

[54] ACCUMULATOR FOR VEHICLE AIR CONDITIONING SYSTEM

[75] Inventors: Manfred Koberstein, Warren; James H. Balcom, Garden City; Stephen M. Kolpacke, Canton, all of Mich.

[73] Assignee: Ford Motor Company, Dearborn, Mich.

[21] Appl. No.: 812,649

[22] Filed: Dec. 23, 1991

[51] Int. Cl.[5] ..... F25B 43/00

[52] U.S. Cl. ..... 62/503; 55/387; 210/282; 210/DIG. 6

[58] Field of Search ..... 62/503; 55/387; 210/282, DIG. 6

[56] References Cited

U.S. PATENT DOCUMENTS

| | | | |
|---|---|---|---|
| 1,978,463 | 10/1934 | Kettering | 62/115 |
| 3,092,978 | 6/1963 | Lorentzen | 62/216 |
| 3,438,218 | 4/1969 | O'Neil | 62/218 |
| 3,488,678 | 1/1970 | Wagner | 62/503 |
| 3,563,053 | 2/1971 | Bottum | 62/503 |
| 3,643,466 | 2/1972 | Bottum | 62/503 |
| 3,796,064 | 3/1974 | Ladusaw | 62/503 |
| 3,798,921 | 3/1974 | Scherer et al. | 62/217 |
| 3,837,173 | 9/1974 | Kuttruff et al. | 62/128 |
| 3,837,177 | 9/1974 | Rockwell et al. | 62/503 |
| 3,957,469 | 5/1976 | Nebash | 55/270 |
| 4,111,005 | 9/1978 | Livesay | 62/503 |
| 4,122,579 | 10/1978 | Parise | 15/353 |
| 4,147,479 | 4/1979 | Morse | 417/540 |
| 4,182,136 | 1/1980 | Morse | 62/503 |
| 4,187,695 | 2/1980 | Schumacher | 62/503 |
| 4,199,960 | 4/1980 | Adams et al. | 62/503 |
| 4,236,381 | 12/1980 | Imral et al. | 62/324 R |
| 4,266,408 | 5/1981 | Krause | 62/474 |
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,354,362 | 10/1982 | Schumacher et al. | 62/474 |
| 4,474,035 | 10/1984 | Amin et al. | 62/503 |
| 4,496,378 | 1/1985 | Kish | 55/316 |
| 4,509,340 | 4/1985 | Mullally et al. | 62/503 |
| 4,528,826 | 7/1985 | Avery,Jr. | 62/503 |
| 4,581,903 | 4/1986 | Kerry | 62/503 |
| 4,611,473 | 9/1986 | Wada et al. | 62/503 |
| 4,651,540 | 3/1987 | Morse | 62/503 |
| 4,675,971 | 6/1987 | Masserang | 29/422 |
| 4,730,465 | 3/1988 | Inoue | 62/503 |
| 4,756,166 | 7/1988 | Tomasov | 62/509 |
| 4,768,355 | 9/1988 | Breuhan et al. | 62/503 |
| 4,800,737 | 1/1989 | Smith et al. | 62/503 |
| 4,835,986 | 6/1989 | Carlisle, Jr. | 62/503 |
| 5,036,972 | 8/1991 | Cullen et al. | 62/503 |

*Primary Examiner*—Ronald C. Capossela

*Attorney, Agent, or Firm*—Roger L. May; Charles H. Ellerbrock

[57] ABSTRACT

An accumulator is provided for use with a vehicle air conditioning system. The accumulator comprises a housing, an inlet tube, an outlet tube, and an outlet tube shield. The housing includes first and second end portions and a cylindrical body portion which are joined together to define an interior chamber. An inlet opening is provided through which refrigerant in an inlet tube enters the interior chamber. The inlet tube directs the incoming flow of refrigerant against the first end portion of the housing. The outlet tube shield is attached to the inlet tube, and prevents the direct passage of refrigerant between the inlet tube and free end of the outlet tube.

12 Claims, 2 Drawing Sheets

ACCUMULATOR FOR VEHICLE AIR CONDITIONING SYSTEM

TECHNICAL FIELD

This invention relates to accumulators for air conditioning systems, and more particularly to vehicle air conditioning systems.

BACKGROUND ART

A vehicle air conditioning system conventionally includes a compressor, a condenser, an evaporator, and an accumulator arranged as a refrigerant circuit. The compressor compresses gaseous refrigerant for delivery to the condenser, where the state of the refrigerant changes from gaseous to liquid. The liquid refrigerant then passes to the evaporator, where an air blower circulates air over the evaporator to the vehicle passenger compartment. The consequent heat transfer from the ambient air to the evaporator causes the refrigerant to change to a mostly gaseous state.

The refrigerant then passes from the evaporator to the accumulator. The function of the accumulator is to separate any remaining liquid refrigerant from the gaseous refrigerant, allowing only gaseous refrigerant to return to the compressor. The residual liquid refrigerant eventually turns to a gaseous state and is then returned to the compressor. The accumulator also provides for recovery of lubricating oil contained in the refrigerant, returning a metered amount of the oil to the inlet side of the compressor.

The accumulator normally is an upright cylindrical housing with an inlet opening formed therein and having an outlet tube with its mouth near the top of the inside of the housing. Refrigerant from the evaporator is introduced into the accumulator through the inlet opening, which may be in the top or in the side of the accumulator housing. Suction created by the compressor draws gaseous refrigerant out of the accumulator through the outlet tube. A desiccant is usually provided to dry the refrigerant as it circulates through the accumulator.

To prevent any liquid refrigerant from entering the outlet tube and being drawn back into the compressor, some structure is typically provided to act as a shield for the mouth of the outlet tube. For example, U.S. Pat. No. 4,474,035 to Amin et al., assigned to the assignee of the present invention, discloses an accumulator having a domed baffle plate adjacent the accumulator opening. Liquid portions of the refrigerant are dispersed through the roof of the accumulator onto the domed baffle plate and the sides of the accumulator, allowing the gaseous components of the refrigerant to accumulate in the upper region of the accumulator adjacent the mouth of the outlet tube. The gaseous refrigerant then exits the accumulator through the outlet tube, which extends through the top of the accumulator.

Because vehicle space constraints such as low hoodlines often restrict the use of a top inlet or top outlet, accumulator designs with side inlets and/or side outlets have been proposed. For example, U.S. Pat. No. 4,291,548 to Livesay discloses an accumulator having a side inlet through which the incoming refrigerant is directed against a frustoconical shaped outlet tube shield. Similarly, U.S. Pat. No. 4,496,378 to Kish discloses an accumulator having a side inlet through which the incoming flow is directed against a deflector attached to the accumulator housing next to the inlet opening. Also, U.S. Pat. No. 4,528,826 to Avery, Jr. discloses an accumulator in which the incoming refrigerant is directed from a side inlet against the top of the accumulator housing. Gaseous refrigerant exits through an unshielded side outlet conduit, optionally after filtering through a desiccant.

SUMMARY OF THE INVENTION

It is an object of the present invention to provide an accumulator comprising a housing, an inlet tube for directing an incoming flow of refrigerant against the top of the housing, an outlet tube extending into the housing, and an outlet tube shield mounted in the housing to prevent the direct passage of refrigerant between the inlet tube and the outlet tube.

Another object of the present invention is to provide an accumulator of the type described above in which the incoming flow of refrigerant is directed against a first end portion of the housing.

It is another object of the present invention to provide an accumulator of the type described above which minimizes the accommodation space required above and below the accumulator housing.

It is another object of the present invention to provide an accumulator of the type described above in which the outlet tube shield is attached to the inlet tube.

In carrying out the above objects and other objects of the present invention, an accumulator is provided for use in a vehicle air conditioning system. The accumulator comprises a housing, an inlet tube, an outlet tube, and an outlet tube shield. The housing includes first and second end portions and a cylindrical body portion which together define an interior chamber. The housing also has an inlet opening through which refrigerant may be introduced into the interior chamber and an outlet opening through which substantially gaseous refrigerant may exit the interior chamber. The inlet tube extends from the inlet opening into the interior chamber, and is adapted to direct the incoming flow of refrigerant against the first end portion of the housing. The outlet tube extends from the outlet opening into the interior chamber and terminates in a free end. The outlet tube shield is attached to the inlet tube between the housing and the free end of the outlet tube to prevent the direct passage of refrigerant between the inlet tube and the free end of the outlet tube.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

With reference to the drawings, the preferred embodiments of the present invention will be described.

Figure 1:
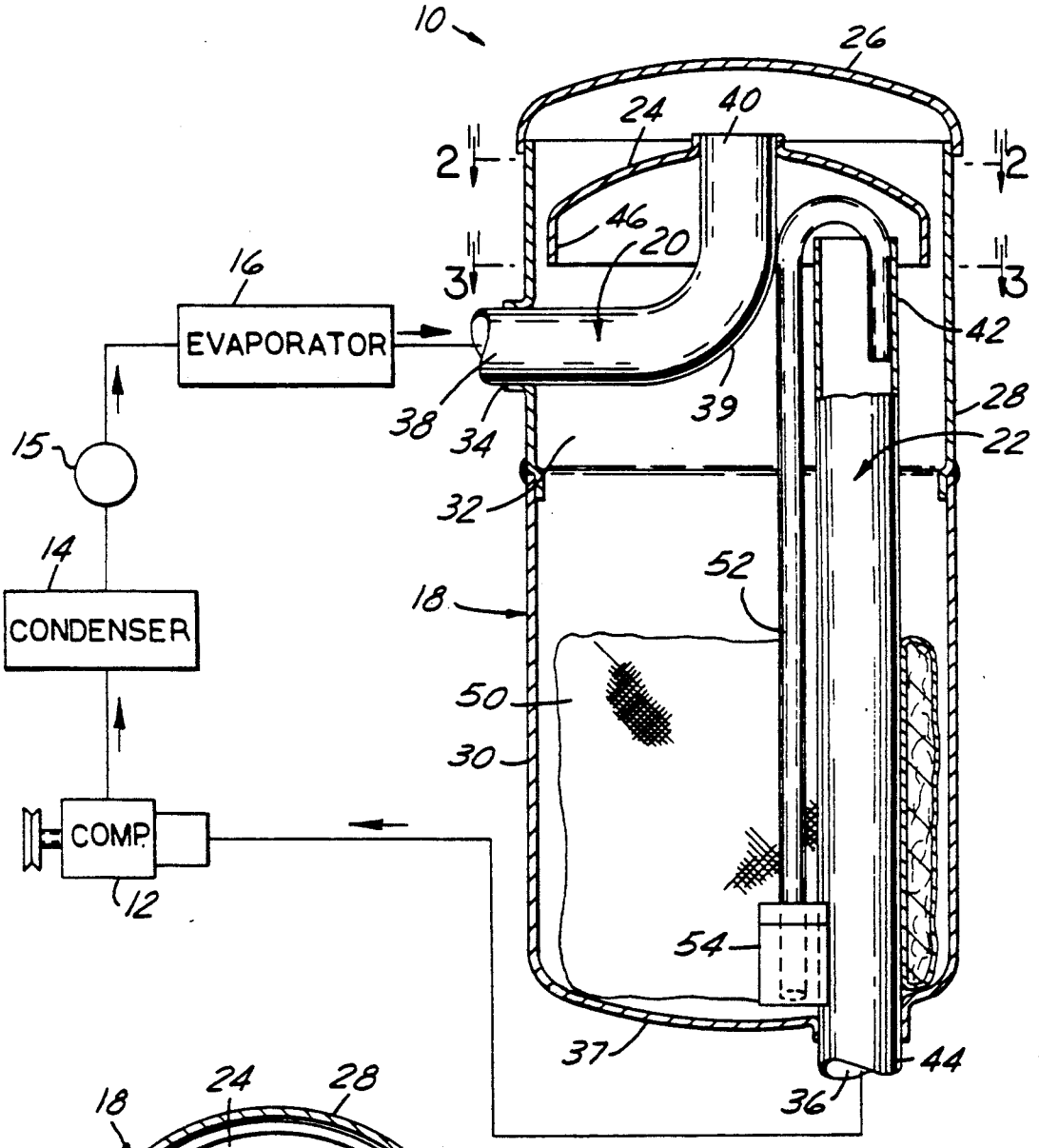
FIG. 1 is a schematic view of a vehicle air conditioning system including a front cross-sectional view of an accumulator according to the present invention.
Figure 2:
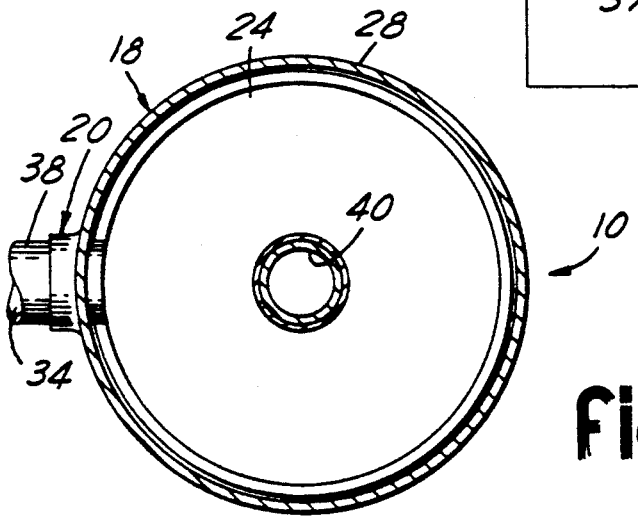
FIG. 2 is a top cross-sectional view of the accumulator taken along line 2—2 of FIG. 1.
Figure 3:
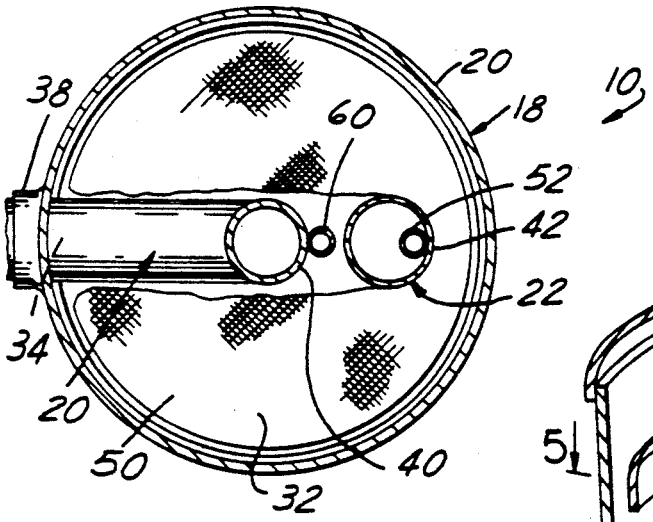
FIG. 3 is a front cross-sectional view of the accumulator taken along line 3—3 of FIG. 1.

FIGS. 1 through 3 show an accumulator 10 for use in a vehicle air conditioning system. As shown schematically in FIG. 1, the air conditioning system may include the accumulator 10, a compressor 12, a condenser 14, an expansion orifice 15, and an evaporator 16 arranged as a refrigerant circuit as indicated by the arrows.

The accumulator 10 comprises a housing 18, an inlet tube 20, an outlet tube 22, and an outlet tube shield 24. All these components may be steel or aluminum. The housing 18 has a dome-shaped first end portion 26, a generally cylindrical body portion 28 welded or brazed to the first end portion 26, and a cup shaped second end portion 30 welded or brazed to the body portion 28. The housing portions 26, 28, and 30 together define an interior chamber 32. Although a three piece housing construction is shown in FIG. 1, one skilled in the art will appreciate that there are other viable designs for the housing, such as connecting upper and lower housing sections together An inlet opening 34 is formed in the body portion 28, and an outlet opening 36 is formed in the bottom 37 of the second end portion 30. A pressure switch port and a service port (not shown) can similarly be provided in the housing 18. The inlet tube 20 includes an inlet fitting section 38 which extends through the inlet opening 34 and is in fluid communication with the evaporator 16. The inlet tube 20 is bent upwardly at an elbow section 39 generally into an L-shape. A free end 40 of the inlet tube 20 is disposed proximate the first end portion 26 such that the inlet tube 20 is adapted to direct the flow of incoming refrigerant substantially against the geometric center of the first end portion 26.

The outlet tube 22 is welded or brazed to the second end portion 30, and extends at least from the outlet opening 36 up into the interior chamber 32 and terminates in a free end 42. Alternatively, the outlet tube 22 may be integrally molded or formed with the second end portion 30. The free end 42 of the outlet tube 22 is situated slightly off center from the longitudinal axis of the accumulator to avoid interfering with the inlet tube 20. Preferably, the mouth of the outlet tube 22 is as far above the level of the liquid that pools in the bottom as possible, even at the expense of being slightly off center. The outlet tube 22 is in the form of a cylinder, such that the free end 42 defines a generally circular mouth having an outside diameter roughly equal to that of the outlet opening 36. A second end 44 of the outlet tube 22 may be provided with connectors (not shown) for hoses to return gaseous refrigerant to the compressor 12.

The outlet tube shield 24 is mounted within the interior chamber 32, preferably by attaching it around the free end 40 of the inlet tube 20. Alternatively, the outlet tube shield 24 can be spot welded or brazed to the interior of the housing 18, as shown and described in U.S. Pat. No. 4,474,035 to Amin et al. The outlet tube shield 24 has a domed shape including a downwardly extending annular flange 46, and is positioned between the first end portion 26 and the free end 42 of the outlet tube 22. In this position, the outlet tube shield 24 functions analogously to an umbrella, preventing the direct passage of refrigerant between the inlet tube 20 and the free end 42 of the outlet tube 22.

A desiccant container 50 is disposed in the interior chamber 32 substantially within the second end portion 30 of the housing 18. The desiccant container 50 rests on the bottom portion 37 of the second end portion 30 around the outlet tube 22. A desiccant molecular sieve is retained within the desiccant container 14 to remove moisture from the refrigerant as it circulates through the accumulator 10.

An oil return quill 52 is provided adjacent the outlet tube 22. The lower end of the oil return quill 52 rests on or near the bottom portion 37 of the second end section 30, and is provided with a filter 54. The upper end of the quill 52 is looped into the free end 42 of the outlet tube 22. When the liquid refrigerant/oil mixture pools in the bottom of lower housing section 30, suction created by the compressor 12 draws the mixture up through the filter 54 and the quill 52, and thereby meters an amount of oil back with the vaporous refrigerant to the compressor 12.

The operation of the accumulator 10 will now be described. The refrigerant, preferably either **R134*a* or R12, circulates through the vehicle air conditioning system and enters the interior chamber 32 through the inlet opening 34 and the inlet tube 20. The incoming refrigerant is initially directed against the geometric center of the first end portion 26. Most of the liquid refrigerant then flows down the inside wall of the body portion 28 or off the outlet tube shield 24, and pools in the bottom of the accumulator. The liquid thereafter steadily evaporates into the low pressure atmosphere of the accumulator. The gaseous or vaporous refrigerant accumulates in the upper region of the accumulator, and exits the interior chamber 32 through the outlet tube 20 and the outlet opening 34 due to the suction created by the compressor 12**.

Figure 4:
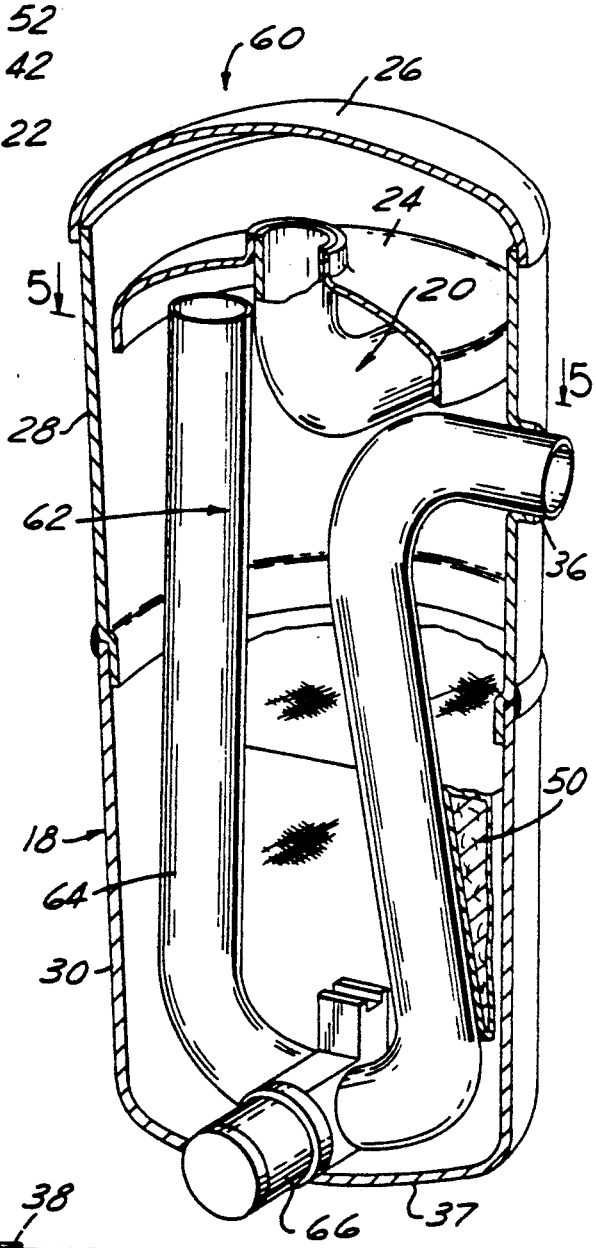
FIG. 4 is a perspective cross-sectional view of an alternative embodiment of an accumulator according to the present invention.
Figure 5:
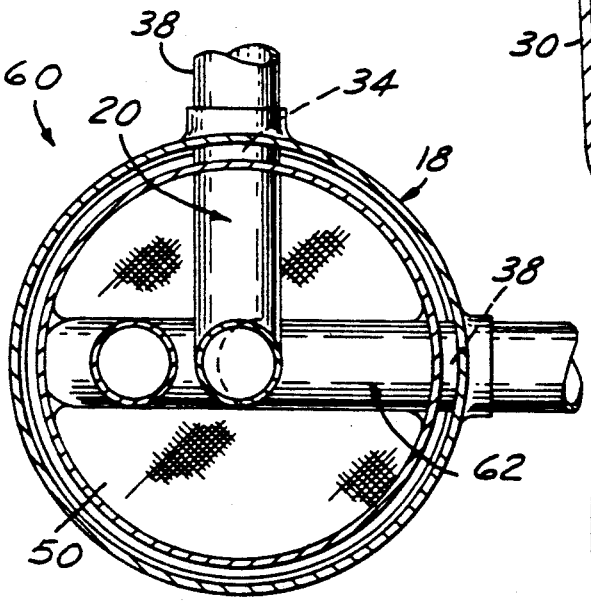
FIG. 5 is a top cross-sectional view taken along line 5—5 of FIG. 4.

FIGS. 4 and 5 show an alternative embodiment of an accumulator 60 according to the present invention having the outlet opening 36 formed in the body portion 28 of the housing 18. This construction is useful, for example, when the vehicle environment with which the accumulator is used imposes space constraints such as a low hoodline. An outlet tube 62 is generally U-shaped, with a vertically depending first section 64 with a free end again situated slightly off center of the longitudinal axis of the housing 12 In place of an oil return quill, a filter 66 covers an oil return orifice (not shown) through which lubricating and cooling oil is metered back to compressor. As on skilled in the art will appreciate, the accumulator of the present invention can be provided with any combination of top or side inlets and bottom or side outlets, without materially affecting performance.

While the best mode for carrying out the invention has been described in detail, those familiar with the art to which this invention relates will recognize various alternative designs and embodiments for practicing the invention as defined by the following claims.

We claim:

1. An accumulator for use in an air conditioning system, the accumulator comprising:

a housing having a first end portion, a body portion, and a second end portion which together define an interior chamber, the housing also having an inlet opening through which refrigerant may enter the inlet chamber and an outlet opening through which refrigerant may exit the interior chamber;

an inlet tube extending from the inlet opening into the interior chamber and adapted to direct the incoming flow of refrigerant against the first end portion of the housing;

an outlet tube extending from the outlet opening into the interior chamber and terminating in a free end; and an outlet tube shield mounted within the interior chamber between the first end portion of the housing and the free end of the outlet tube to prevent the direct passage of refrigerant between the inlet tube and the free end of the outlet tube.

2. The accumulator of claim 1 wherein the outlet tube shield is attached to the inlet tube.

3. The accumulator of claim 1 wherein the outlet tube shield is generally dome-shaped.

4. The accumulator of claim 1 wherein the inlet tube is adapted to direct the incoming flow of refrigerant substantially against the center of the first end portion of the housing.

5. The accumulator of claim 1 wherein the first end portion of the housing is generally dome-shaped.

6. The accumulator of claim 1 wherein the inlet opening is disposed in the body portion of the housing.

7. The accumulator of claim 1 wherein the outlet opening is disposed in the second end portion of the housing.

8. The accumulator of claim 1 wherein the outlet tube is disposed in the body portion of the housing.

9. The accumulator of claim 1 further comprising a desiccant container disposed in the interior chamber.

10. The accumulator of claim 9 wherein the desiccant container is disposed substantially within the second end portion of the housing.

11. An accumulator for use in a vehicle air conditioning system, the accumulator comprising:

a housing having a first end portion, a body portion connected to the first end portion, and a second end portion connected to the body portion to define an interior chamber, the housing also having an inlet opening disposed in the body portion through which refrigerant may enter the inlet chamber and an outlet opening disposed in the second end portion through which refrigerant may exit the interior chamber;

an inlet tube extending from the inlet opening into the interior chamber and adapted to direct the incoming flow of refrigerant substantially against the center of the first end portion of the housing;

an outlet tube extending from the outlet opening into the interior chamber and terminating in a free end; and an outlet tube shield attached to the inlet tube and extending between the first end portion of the housing and the free end of the outlet tube to prevent the direct passage of refrigerant between the inlet tube and the free end of the outlet tube.

12. An accumulator for use in an air conditioning system, the accumulator comprising:

a housing having a first end portion, a body portion, and a second end portion which together define an interior chamber, the housing also having an inlet opening through which refrigerant may enter the inlet chamber and an outlet opening through which refrigerant may exit the interior chamber;

an inlet tube extending from the inlet opening into the interior chamber and adapted to direct the incoming flow of refrigerant against the first end portion of the housing;

an outlet tube extending from the outlet opening into the interior chamber and terminating in a free end; and an outlet tube shield attached to the inlet tube between the first end portion of the housing and the free end of the outlet tube to prevent the direct passage of refrigerant between the inlet tube and the free end of the outlet tube.

* * * * *